US005286180A

United States Patent [19]

Scarlett

[11] Patent Number: 5,286,180

[45] Date of Patent: Feb. 15, 1994

[54] METHOD FOR ATTACHING FIXED SCROLL TO REAR HEAD OF SCROLL COMPRESSOR

[75] Inventor: Eric W. Scarlett, South Lyon, Mich.

[73] Assignee: Ford Motor Company, Dearborn, Mich.

[21] Appl. No.: 43,613

[22] Filed: Apr. 8, 1993

Related U.S. Application Data

[63] Continuation of Ser. No. 880,780, May 11, 1992, abandoned.

[51] Int. Cl.[5] ..... F01C 1/04

[52] U.S. Cl. ..... 418/55.1; 29/888.022

[58] Field of Search ..... 418/55.1, 55.4; 29/888.022; 403/308, 305, 306, 300

[56] References Cited

U.S. PATENT DOCUMENTS 4,547,138 10/1985 Mabe et al. .
4,815,952 3/1989 Hasegawa .
5,088,906 2/1992 Richardson ..... 418/55.4

*Primary Examiner*—Richard E. Gluck
*Attorney, Agent, or Firm*—Raymond L. Coppiellie; Roger L. May

[57] ABSTRACT

A scroll compressor comprises a fixed scroll, a rear head, and means for mounting the fixed scroll in the rear head, including a plurality of pins press-fitted into bores in upstanding bosses disposed intermediate the fixed scroll and rear head.

7 Claims, 3 Drawing Sheets

METHOD FOR ATTACHING FIXED SCROLL TO REAR HEAD OF SCROLL COMPRESSOR

This application is a continuation of application Ser. No. 07/880,780, filed May 11, 1992 now abandoned.

FIELD OF THE INVENTION

This invention relates to a method for attaching a fixed scroll to the rear head of a scroll compressor. More particularly, the invention is directed to the use of a plurality of mounting pins for securing a fixed scroll to the rear head of a scroll compressor. This eliminates the potential for a compressed fluid to pass between the compression chamber and the discharge chamber, or from the compressor discharge chamber to the atmosphere, as is common in prior art compressors which utilize bolts to fasten the fixed scroll to the rear head of the scroll compressor

BACKGROUND OF THE INVENTION

It is well known in the scroll compressor art to attach the fixed scroll to the rear head of the compressor by means of threaded fasteners. This method of attachment, however, often over time results in the loss of compressor efficiency due to leakage of the compressed fluid past the bolt holes, or failure of the compressor due to the deterioration of the scroll elements as a result of loosened bolts allowing the fixed scroll to separate from the rear head.

U.S. Pat. No. 4,815,952 to Hasegawa discloses a method for securing the fixed scroll into the rear head of a scroll compressor, utilizing bolts extending through holes in the end plate of the fixed scroll. It is furthermore disclosed that an optional bottom plate may be employed to cover the heads of the attaching bolts, to assist in preventing blow-by of the compressed fluid between the compression chamber and the discharge chamber. It is evident to one ordinarily skilled in the art, however, that the bolts may work themselves loose over time during operation of the compressor, thereby causing the disengagement of the optional bottom plate from the surface of the end plate as a result of contact between the bolt heads and the adjacent surface of the bottom plate. Thus, compressed fluid could pass between the compression chamber and the discharge chamber along the bolt holes through the end plate thereby reducing the efficiency of the compressor, and the bottom plate could be urged away from the end plate a sufficient distance to interfere with the operation of the orbiting scroll elements thereby causing the compressor to seize and fail. Moreover, in the disclosed alternative embodiment, which does not include a bottom plate, these same inefficiencies and failures could occur more quickly.

U.S. Pat. No. 4,547,138 to Mabe et al. likewise discloses a method for securing the fixed scroll into the rear head of a scroll compressor. Bolts extending through holes in the rear head are secured into threaded shanks formed on the end plate of the fixed scroll opposite the fixed scroll elements. As is evident to one ordinarily skilled in the art, these bolts may loosen over time during operation of the compressor, thereby allowing the fixed scroll to disengage from the rear head of the compressor. Thus, compressed fluid could escape from the discharge chamber to the atmosphere along the bolt holes through the rear head, and the fixed scroll could move away from its intended position adjacent the rear head causing interference with the operation of the orbiting scroll elements.

It would be desirable to provide a method for securing the fixed scroll into the rear head of a scroll compressor in a manner which would eliminate the potential for the compressed fluid to pass between the compression chamber and the discharge chamber, or from the compressor discharge chamber to the atmosphere.

SUMMARY OF THE INVENTION

Accordant with the present invention, a method for rigidly attaching the fixed scroll to the rear head of a scroll compressor surprisingly has been discovered. The method utilizes pins which are press-fitted into bores in upstanding bosses extending from either or both of the fixed scroll end plate and the rear head.

The inventive scroll compressor comprises:

A) a fixed scroll, having an end plate including a surface;

B) a rear head into which the fixed scroll is mounted, the rear head including a surface apposing the surface of the end plate, at least portions of said rear head and end plate surfaces cooperating to define a discharge chamber; and C) means for attaching the fixed scroll in the rear head, including a plurality of pins press-fitted into bores in upstanding bosses disposed intermediate the fixed scroll and rear head surfaces.

The scroll compressors according to the present invention are particularly well suited for use in vehicle air conditioning systems.

BRIEF DESCRIPTION OF THE DRAWINGS

The novel features which are characteristic of the present invention are set forth with particularity in the appended claims. The invention itself, however, both as to structure and method of manufacture will best be understood from the accompanying description of specific embodiments, when read in connection with the drawings, in which:

DETAILED DESCRIPTION OF THE PREFERRED EMBODIMENT

Scroll compressors are well-known in the art as useful devices for compressing refrigeration fluids for use in cooling systems, e.g., vehicle air conditioners. Scroll compressors typically include fixed and orbiting scrolls, each having circular end plates and spiroidal scroll elements. The scrolls are maintained at an angular and radial offset so that the spiroidal scroll elements interfit to form a plurality of line contacts between their curved surfaces, to thereby seal off and define at least one pair of fluid pockets. The motion of the orbiting scroll shifts the line contacts along the surfaces of the spiroidal elements, and the volume of the fluid pockets increases or decreases depending upon the direction of the orbital motion. The fluid pockets collectively define the compression chamber of the scroll compressor.

Figure 1:
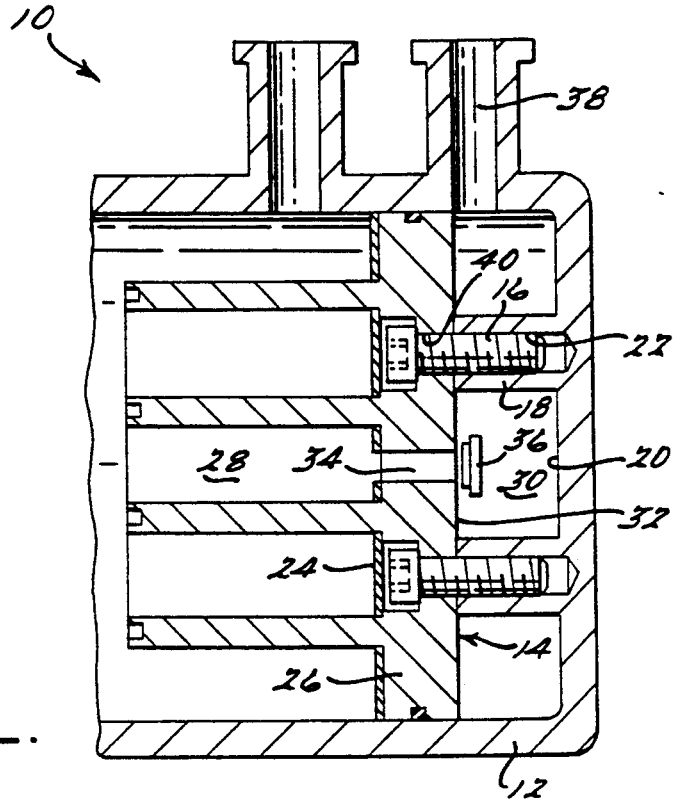
Prior Art FIG. 1.
FIG. 1 is a fragmentary, cross-sectional view of a portion of a scroll compressor, according to the prior art.

Referring now to the drawings, and particularly to FIG. 1, there is shown generally at 10 a portion of a scroll compressor according to the prior art, comprising a rear head 12 and a fixed scroll 14 mounted therein by means of threaded fasteners or bolts 16. A plurality of bosses 18 are formed in and extend from the inner surface 20 of the rear head 12. A threaded hole 22 is formed in each boss 18 for receiving the bolts 16. An optional bottom plate 24 is disposed on the end plate 26 of the fixed scroll 14, to cover the heads of the bolts 16 and prevent blow-by of compressed fluid between the compression chamber 28 and the discharge chamber 30. The discharge chamber 30, defined by at least a portion of the inner surface 20 of the rear head 12 and the apposing surface 32 of the fixed scroll 14, receives compressed fluid from the compression chamber 28 via a discharge port 34 and associated check valve 36, and communicates the compressed fluid to the outlet conduit 38.

It will be readily evident to one ordinarily skilled in the compressor art that such a prior art scroll compressor 10 could become inefficient in operation and/or cease to operate if one or more of the bolts 16 were to loosen over time. One or more of the bolts 16 could loosen to such a degree that the bottom plate 24 would be urged against the spiroidal elements of the orbiting scroll (not shown), possibly causing the compressor 10 to seize and fail. Moreover, the bolts 16 may loosen and the bottom plate 24 may be displaced to such a degree that compressed fluid would be allowed to flow between the discharge chamber 30 and the compression chamber 28 via the bolt holes 40 which extend through the end plate 26 of the fixed scroll 14. This would cause the compressor efficiency to drop, whether blow-by was occurring from the compression chamber to the discharge chamber, or from the discharge chamber to the compression chamber.

Figure 2:
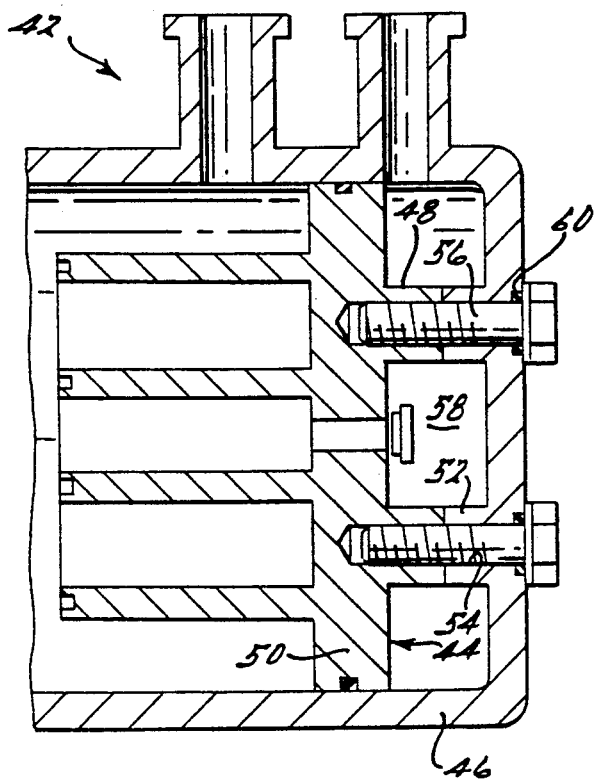
Prior Art FIG. 2.
FIG. 2 is a fragmentary, cross-sectional view of a portion of another scroll compressor, according to the prior art.

FIG. 2 illustrates yet another embodiment of a portion of a scroll compressor 42 according to the prior art. This scroll compressor 42 is similar to the scroll compressor 10 of FIG. 1, except for the means for attaching the fixed scroll 44 to the rear head 46. A plurality of internally threaded bosses 48 extend from the end plate 50 of the fixed scroll 44. The axial end surfaces of the threaded bosses 48 are mated to the axial end surfaces of associated rear head bosses 52 which include coaxial bores 54 extending through the rear head 46. A plurality of bolts 56 are inserted through the bores 54 to engage the threaded bosses 48, and thereby secure the fixed scroll 44 to the rear head 46.

As will be evident to those ordinarily skilled in the compressor art, the prior art scroll compressor 42 illustrated in FIG. 2 could leak compressed fluid to the atmosphere and/or cease to operate if one or more of the bolts 56 were to loosen over time. If one or more of the bolts 56 were to loosen, the end plate 50 of the fixed scroll 44 would be allowed to move in a direction toward the orbiting scroll (not shown), possibly causing the compressor 42 to seize and fail. Furthermore, compressed fluid would be allowed to escape from the discharge chamber 58 to the atmosphere, via a gap between the apposing axial end surfaces of the threaded bosses 48 and the rear head bosses 52, thence along the bores 54 to the atmosphere. Seal rings 60 would not effectively prevent the blow-by of compressed fluid if the bolts became loose.

The present invention eliminates the possibilities of blow-by between the compression and discharge chambers, and the escape of compressed fluid from the discharge chamber to the atmosphere, as inherently provided for in the prior art scroll compressor designs.

Figure 3:
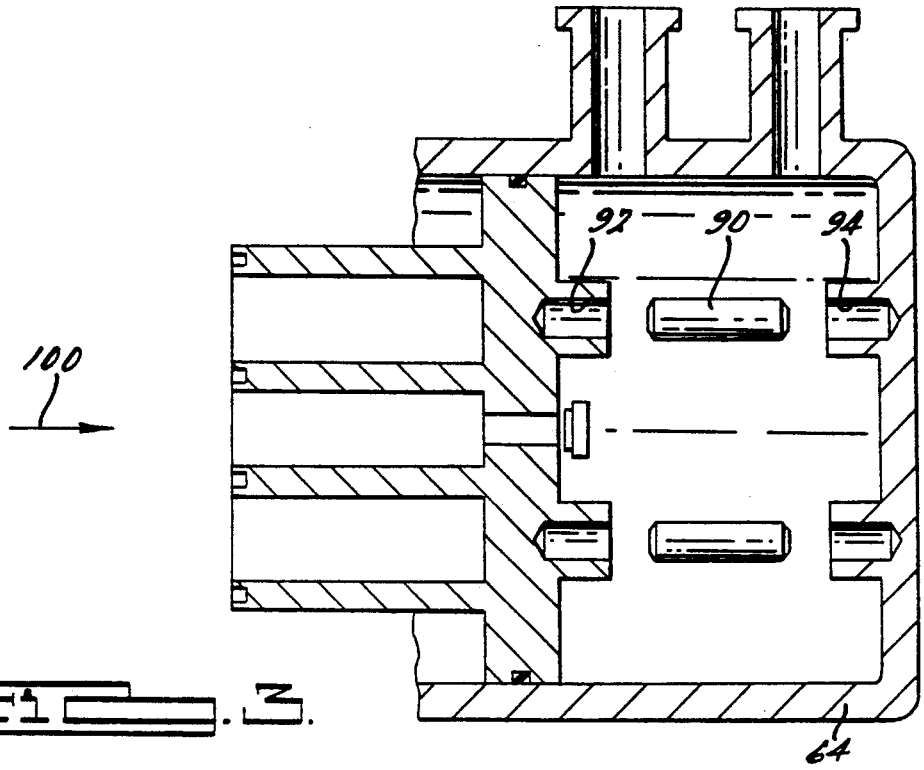
FIG. 3 is a fragmentary, cross-sectional view of the fixed scroll, rear head, and mounting pins, illustrating the fixed scroll securely mounted into the rear head, according to an embodiment of the present invention.

FIG. 3 illustrates a portion of a scroll compressor 62 embodying the features of the present invention. The scroll compressor 62 comprises, inter alia, a rear head 64 having a fixed scroll 66 mounted therein. The fixed scroll 66 includes a generally circular end plate 68 and a plurality of perpendicularly oriented spiroidal elements 70. The fixed scroll 66 further includes a discharge port 72 through which compressed fluid may flow, from a compression chamber 74 past a check valve 76 thence into a discharge chamber 78, during operation of the compressor 62. Fluid to be compressed enters the compression chamber 74 via an inlet conduit 80, and compressed fluid exits the discharge chamber 78 via an outlet conduit 82. The fluid in the discharge chamber 78 is segregated from the fluid in the compression chamber 74 by means of a seal 84 between the circumferential end surface of the end plate 68 and the cylindrical surface of the rear head 64.

The rear head 64 includes an inner surface 86 apposing a surface 88 of the fixed scroll 66. At least portions of the inner surface 86 of the rear head 64 and portions of the surface 88 of the fixed scroll 66 cooperate to define the discharge chamber 78, which communicates compressed fluid from the discharge port 72 to the outlet conduit 82 during operation of the scroll compressor 62. By the term "rear head", as used in the present specification, is meant any generally cup-shaped housing, at least a portion of whose inner surface is capable of cooperating with at least a portion of a surface of a fixed scroll end plate to enclose and define a discharge chamber for receiving a compressed fluid from the scroll compressor and communicating same to an outlet conduit.

The fixed scroll 66 is attached to the rear head 64 by means of a plurality of pins 90 which are press-fitted into blind coaxial bores 92 and 94 in upstanding bosses 96 and 98, respectively, extending from the surface 88 of the fixed scroll 66 and from the inner surface 86 of the rear head 64, respectively. The upstanding bosses 96 and 98 are disposed intermediate the fixed scroll surface 88 and the rear head inner surface 86. This configuration precludes the blow-by of compressed fluid between the compression chamber 74 and the discharge chamber 78, and eliminates the possibility of the loss of compressed fluid from the discharge chamber 78 to the atmosphere. The techniques of press-fitting baculiform structures into mating bores, to effect a rigid interference fit therebetween, are well-known in the art and, therefore, will not be discussed further. It is also well-known to add serrations to the surfaces of the pins 90, to assist in locking the pins 90 into the bores 92 and 94. As will be apparent to those ordinarily skilled in the compressor art, the bosses 92 and 94 may be formed as an integral part of the fixed scroll 66 and/or rear head 64, respectively. Alternatively, the bosses 92 and 94 may be separately manufactured and rigidly attached to the surface 88 of the fixed scroll 66 and the inner surface 86 of the rear head 64, respectively, by conventional techniques, e.g., by welding. Furthermore, other conventional modifications resulting in the same operability and utility may be made. For example, the diameters and/or surface configurations of the pins 90 and bores 92 and 94, the numbers of pins 90 and bores 92 and 94, and the lengths of the pins 90 and bores 92 and 94, may each, independently be altered.

Figure 4:
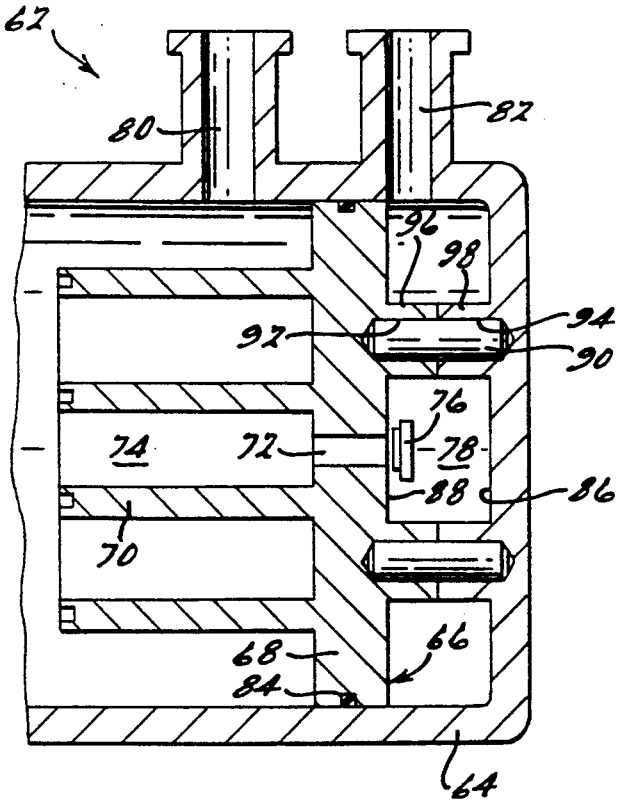
FIG. 4 is a fragmentary, cross-sectional view of the fixed scroll, rear head, and mounting pins of FIG. 3, prior to the fixed scroll being mounted into the rear head, embodying the features of the present invention.

FIG. 4 illustrates the scroll compressor 64 of FIG. 3 just prior to the press-fitting operation. The pins 90 and associated bores 92 and 94 are coaxially aligned, and the fixed scroll 66 is urged relative to the rear head 64 in the direction of the arrow 100, to press-fit and lock the pins 90 into the bores 92 and 94.

Figure 5:
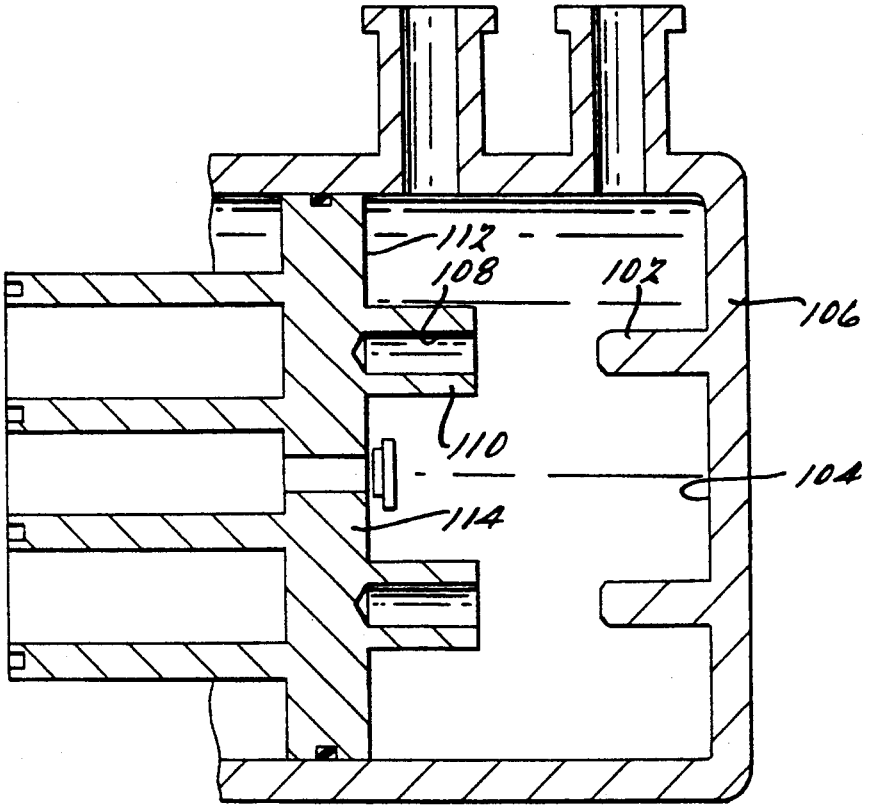
FIG. 5 is a fragmentary, cross-sectional view of an alternative embodiment for securing the fixed scroll to the rear head according to the present invention.

FIG. 5 illustrates an alternative embodiment of the attachment means according to the present invention. Pins 102 extend from the inner surface 104 of the rear head 106, and are adapted to be press-fitted into coaxial bores 108 in upstanding bosses 110 which extend from the surface 112 of the fixed scroll end plate 114. The pins 102 and/or upstanding bosses 110 may be formed as an integral part of the rear head 106 and end plate 114, respectively, or may separately be manufactured and attached thereto by conventional techniques, e.g., by welding. The upstanding bosses 110 are disposed intermediate the fixed scroll surface 112 and the rear head inner surface 104. It will be apparent to those ordinarily skilled in the compressor art that, alternatively, the configuration where pins are attached to the surface of the end plate and bosses are attached to the inner surface of the rear head, would have the same operability and utility as the configuration illustrated in FIG. 5. Furthermore, the diameters, lengths, surface configurations, and number of pins and bores may be varied by the skilled routineer as a matter of design choice.

An adhesive may optionally be used in conjunction with the pins and bores of the present invention. The adhesive is applied to the surfaces of the pins and/or bores before the pins are press-fitted into the bores. Any conventional adhesive known to those ordinarily skilled in the art as useful for joining metal surfaces may be used. Convenient adhesives include fast-curing resins and thermoset plastics such as, for example, those sold by Loctite Corporation of Newington, Conn. under the product designations Loctite Retaining Compounds 609 and 620.

From the foregoing description, one ordinarily skilled in the art can easily ascertain the essential characteristics of the present invention, and without departing from the spirit and scope thereof, can make changes and modifications in the invention to adapt it to various usages and conditions.

I claim:

1. A scroll compressor, comprising:

A) a fixed scroll, having an end plate including a surface;

B) a rear head into which the fixed scroll is mounted, the rear head including a surface apposing the surface of the end plate, at least portions of said rear head and end plate surfaces cooperating to define a discharge chamber; and C) means for attaching the fixed scroll in the rear head, said means consisting of a plurality of pins press-fitted into bores in upstanding bosses disposed intermediate the fixed scroll and rear head surfaces.

2. The scroll compressor according to claim 1, wherein the bosses extend from the surface of the end plate toward the rear head.

3. The scroll compressor according to claim 1, wherein the bosses extend from the inner surface of the rear head toward the end plate.

4. The scroll compressor according to claim 1, wherein bosses extend from both the surface of the end plate toward the rear head and from the inner surface of the rear head toward the end plate.

5. The scroll compressor according to claim 1, wherein the pins extend from the surface of the end plate toward the rear head.

6. The scroll compressor according to claim 1, wherein the pins extend from the inner surface of the rear head toward the end plate.

7. A scroll compressor, comprising:

A) a fixed scroll, having an end plate including a surface;

B) a rear head into which the fixed scroll is mounted, the rear head including a surface apposing the surface of the end plate, at least portions of said rear head and end plate surfaces cooperating to define a discharge chamber;

C) a plurality of first upstanding bosses having blind bores therein extending from the surface of the end plate toward the rear head;

D) a plurality of second bosses having blind bores therein extending from the inner surface of the rear head toward the end plate, the bores of associated first and second bosses being coaxial; and E) means for attaching the fixed scroll in the rear head, said means consisting of a plurality of pins press-fitted into the first and second bosses.

* * * * *